United States Patent [19]

Brandon et al.

[11] Patent Number: 4,942,679

[45] Date of Patent: Jul. 24, 1990

[54] STYLED COMFORT SHOE CONSTRUCTION

[75] Inventors: Michael D. Brandon, Snyrna; Robert A. Dorris, Hermitage; Robert T. Garrett, Hendersonville; Roy N. Helton, Smyrna; Don G. Roney, Madison; James R. Vinson, Clarksville, all of Tenn.

[73] Assignee: Genesco, Inc., Nashville, Tenn.

[21] Appl. No.: 313,168

[22] Filed: Feb. 21, 1989

[51] Int. Cl.[5] ..... A43B 13/37; A43B 13/40; A43B 13/18

[52] U.S. Cl. ..... 36/102; 36/44; 36/24.5; 36/108

[58] Field of Search ..... 36/24.5, 44, 83, 30 R, 36/30 A, 25 R, 102, 103, /107, 108, 4, 97

[56] References Cited

U.S. PATENT DOCUMENTS

| | | | |
|---|---|---|---|
| 1,282,399 | 10/1918 | Egerton | 36/30 R |
| 1,472,109 | 10/1923 | Winkley | 36/24.5 |
| 1,741,747 | 12/1929 | Wentworth | 36/24.5 |
| 2,605,559 | 8/1952 | Vail | 36/30 A |
| 2,817,163 | 12/1957 | Clark | 36/30 R |
| 3,344,537 | 10/1967 | Diamant | 36/44 |
| 3,416,245 | 12/1968 | Ferraira | 36/44 |
| 3,705,463 | 12/1972 | Lown | 36/25 R |
| 4,133,118 | 1/1979 | Khalsa et al. | 36/44 |
| 4,463,505 | 8/1984 | Duclos | 36/25 R |
| 4,542,598 | 9/1985 | Misench et al. | 36/107 |

OTHER PUBLICATIONS

Poron Brochure, Rogers Corporation ©1968.

*Primary Examiner*—Steven N. Meyers
*Attorney, Agent, or Firm*—Harrington A. Lackey

[57] ABSTRACT

A styled shoe construction designed for comfort including a flexible, durable, synthetic outsole member having a narrow heel or tongue portion received in the recess of a styled leather heel. The shoe construction further includes a synthetic fiberboard insole member in which its backpart area is substantially rigid while its forepart area is substantially flexible, is lightweight, breathable, and water-absorptive, and is cement-lasted between the inturned marginal edges of a styled leather upper and the top surfaces of the marginal edges of the outsole member and heel. A highly resilient elongated urethane foam bottom filler is received within the cavity between the insole member and the outsole member, and a heel cushion member preferably of the same material as the bottom filler is secured to the top backpart surface of the insole member. Secured on the top of the heel member and insole member is an elongated socklining insert member of foam material covered with a leather lining, to provide maximum conformity for the foot, wear, flexibility, and comfort without sacrifice of exterior styling.

19 Claims, 4 Drawing Sheets

STYLED COMFORT SHOE CONSTRUCTION

BACKGROUND OF THE INVENTION

This invention relates to shoe construction, and more particularly to a shoe particularly designed for maximum comfort without sacrifice of styling.

Today, conventional footwear, exclusive of athletic footwear, is little different in structural and functional design than the footwear of 50 to 75 years ago. Improvements have been made in the structural engineering of shoes, that is shoe making, in improving the dynamics of the shoe structure, as opposed to the "biomechanics" of the mechanical function of the foot relative to the shoe, insofar as conventional footwear is concerned. Substantial strides have been made in the biomechanics of athletic and athleisure footwear by constantly improving the structure and the material in the athletic and athleisure shoes to improve the comfort of the wearer. On the other hand, very little improvement has been made in conventional or dress shoes, particularly dress shoes of high style.

However, improved synthetic materials have been used in both conventional and dress shoes as well as in athletic and athleisure shoes.

Ethylene vinyl acetate (EVA) is a well known synthetic material made from ethylene and a vinyl radical to produce an outsole material of lighter weight than leather of a high degree of resilience, flexibility, and longer wear than leather. EVA outsoles have been used in leisure and dress shoes.

A urethane foam material under the trade name of "PORON" produced by the Rogers Corporation of East Woodstock, Conn. has been used in bottom fillers for some shoes. "PORON" has a high degree of resilience or elasticity and therefore when used as a bottom filler resists the "molded" shape in the insole produced by the compressibility and lack of resilience in prior filler materials such as ground cork or felt. Because of its greater elasticity, the improved urethane foam material maintains a substantially uniform level area in the ball area of the foot for supporting the metatarsal bone heads. "PORON" has been used extensively in athletic and casual shoes and in moccasin-type shoe construction for cushion support and shock protection, primarily as a bottom filler, and sometimes as an insole.

Flexible fiberboard, such as fiberboard produced under the "TEXON" trademark, by the Emhart Company, has been used as an insole piece.

Fiberboard tucks and steel shanks are well known in the art of shoe construction for supporting the backpart of the heel and instep of the foot.

Polyethlyene foam insert liners have been used in athletic shoes and leisure shoes.

A typical highly stylized dress shoe is made with a leather upper, leather heel, leather outsole, and leather or synthetic insole member with a tuck and steel shank. Moreover, such dress shoes are usually provided with stitched welts of leather in a manner to provide a highly esthetic appearance.

SUMMARY OF THE INVENTION

It is therefore an object of this invention to provide a shoe construction having a highly styled exterior appearance preferably made of leather, but in which the interior parts, and particularly the insole, the outsole, heel, and the sock lining insert incorporate materials characterized by a higher degree of comfort, including greater elasticity, breathability, shock absorption, and water absorptiveness, as well as being lighter in weight and longer in wear than conventional styled leather shoes.

The styled shoe made in accordance with this invention includes a conventional leather upper, a leather heel of unique construction, and an improved outsole member producing an exterior appearance practically identical to the styled cress shoe.

The styled shoe made in accordance with this invention includes a laminated fiberboard insole designed to maintain rigidity in the backpart portion yet to be substantially flexible in its forepart area. Although the rigidity of the backpart portion of the insole member produces superior shock absorbing characteristics, nevertheless, the rigid backpart area of the insole member is sandwiched between a pair of urethane foam layers, a bottom filler below, and a heel cushion member above, in order to improve the elasticity and resilience, particularly in the backpart area, for maximum comfort. Such backpart structural shoe construction is designed to absorb the maximum impact to the shoe in walking, since the heel always strikes the ground or floor surface first.

The styled shoe made in accordance with this invention also includes an improved socklining insert member made of a foam material which is lightweight, soft, porous, highly water absorbent, yet designed to ultimately mold itself to the shape of the foot. The molded set of the socklining member is in contrast to the greater degree of elasticity of the other layers of the shoe construction including the heel cushion member, the insole member, the bottom filler, and the outsole member and heel. This combination of layers of synthetic material contains "the best of both worlds" in shoe comfort.

A further object of this invention is to provide a styled shoe construction incorporating a heel member having a leather heel base, a rubber toplift, and a recess in the top of the heel base for receiving the backpart portion of reduced width of an elongated synthetic, flexible outsole member. Thus, the resilience of the backpart of the outsole member, preferably of ethlyene vinyl acetate having a superior softness and resilience, is positioned in the center of the heel area, yet is completely obscured from view by the surrounding styled leather portion of the heel.

DESCRIPTION OF THE PREFERRED EMBODIMENT

Figure 1:
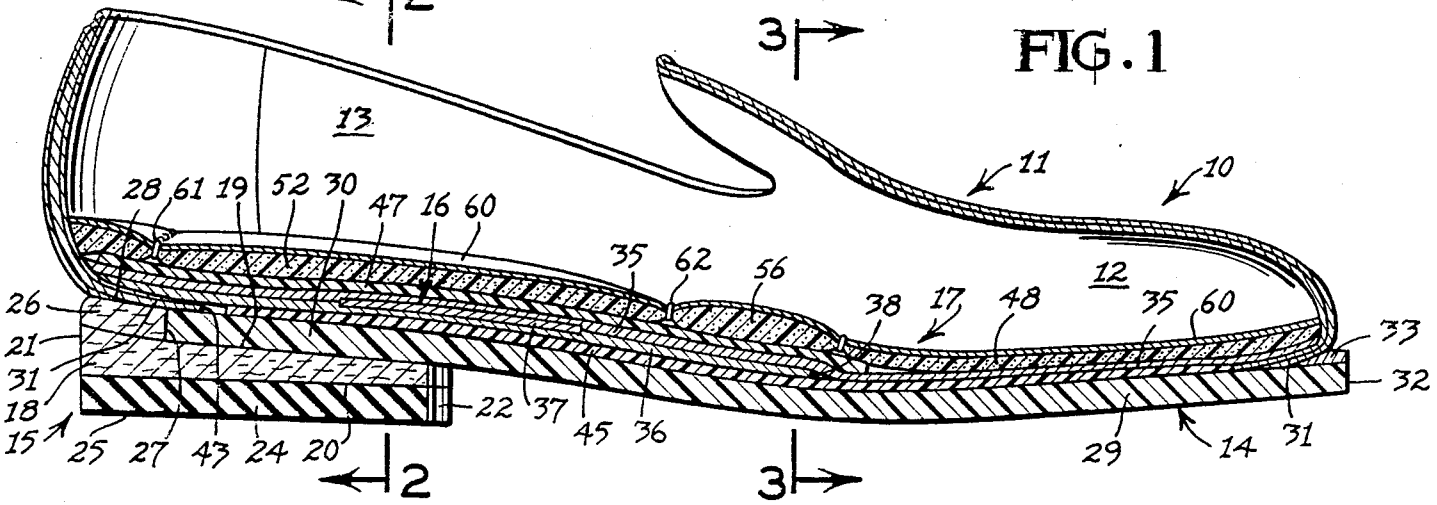
FIG. 1 is a longitudinal vertical section taken along the line 1—1 of FIG. 6 of a styled shoe made in accordance with this invention, in which all of the parts have been assembled.

Referring now to the drawings in more detail, the shoe 10 made in accordance with this invention, as disclosed in FIGS. 1–3 and 6, basically includes a highly styled leather upper 11 having a forepart 12, and a backpart 13, an outsole member 14, a heel 15, an insole member 16, and socklining insert member 17.

The heel member 15 is constructed of a leather heel base 18 having a top surface 19, a bottom surface 20, and a marginal edge 21 extending continuously around the back and both sides of the heel base 18. The heel base 18 includes a curved front edge 22 which is concave forward in a conventional manner. Secured, such as by cementing to the bottom surface 20, is a conventional rubber toplift 24 having a bottom heel surface 25, which may be roughened or lined to provide improved traction.

In a preferred form of the invention, a U-shaped leather heel rand is secured by cement to the top surface 19 along and coextensive with its marginal edge 21. The heel rand 26 defines a central and forwardly opening recess 27 on the top surface 19 of the heel pad 18. The top U-shaped peripheral surface 28 of the heel rand 26, surrounding the recess 27, is preferably coextensive and flush with the marginal edge 21 of the heel base 18. Both the marginal edge 21 and the peripheral surface 28 are highly dressed and polished to display the appearance of a highly styled heel.

The outsole member 14 is preferably made of a monolithic synthetic composition material which is lighter in weight and more wear resistant than leather and which is flexible and highly resilient or elastic. A preferred material for the outsole member 14 is ethylene vinyl acetate (EVA). In a preferred form of the invention, the outsole member is preferably about ¼' thick and extends substantially the entire length of the shoe 10. The outsole member 14 includes a forepart portion 29 and a backpart portion terminating in a heel or tongue portion 30 of lesser width than the heel member 15 or the outsole member 14. The tongue portion 30 has the same arcuate shape as the recess 27 so that the tongue portion 30 of the outsole member fits snugly within and is received by the recess 27. The top surface of the tongue portion 30 does not project above the top surface 28 of the heel member 15 or rand 26. As best disclosed in FIGS. 1 and 6, the tongue portion 30 is completely contained and received and concealed from view within the heel member 15.

Figure 4:
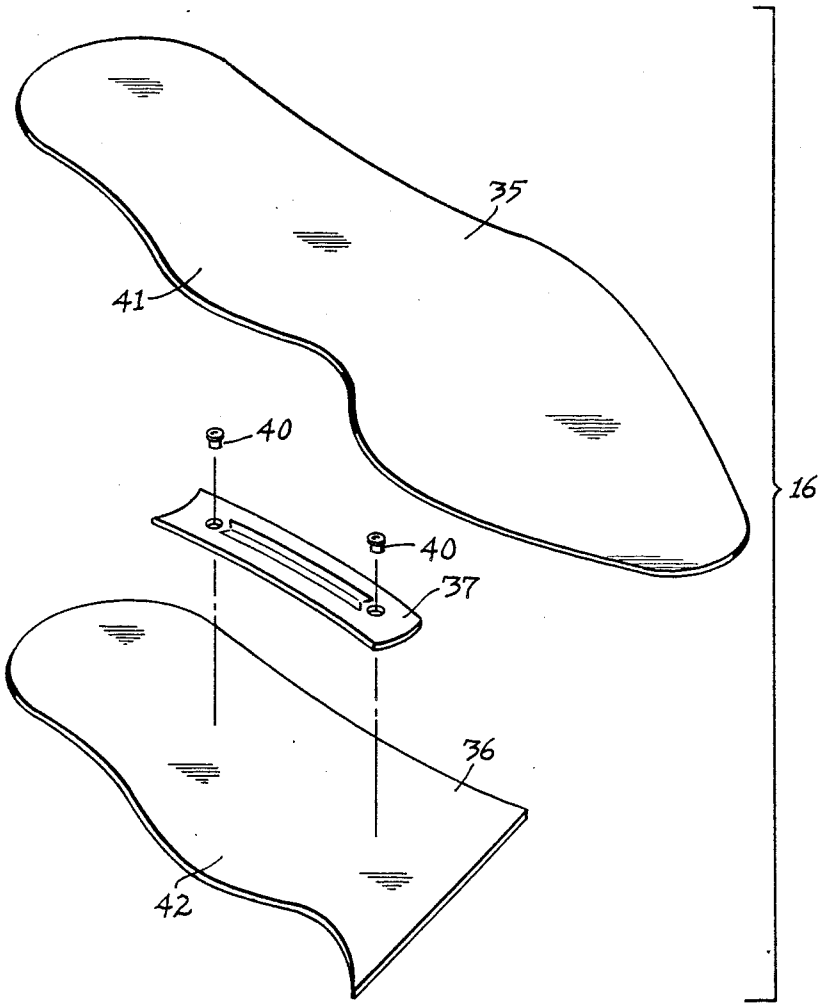
FIG. 4 is a top perspective exploded view of the elements of the insole member.

The upper 11 has a depending inturned bottom marginal portion 31 extending entirely around the shoe and which is cemented to the top surface 28 of the rand 26 and to the top of the periphery of the side and forepart edge 32 of the outsole member 14, as best disclosed in FIGS. 1 and 4.

Figure 6:
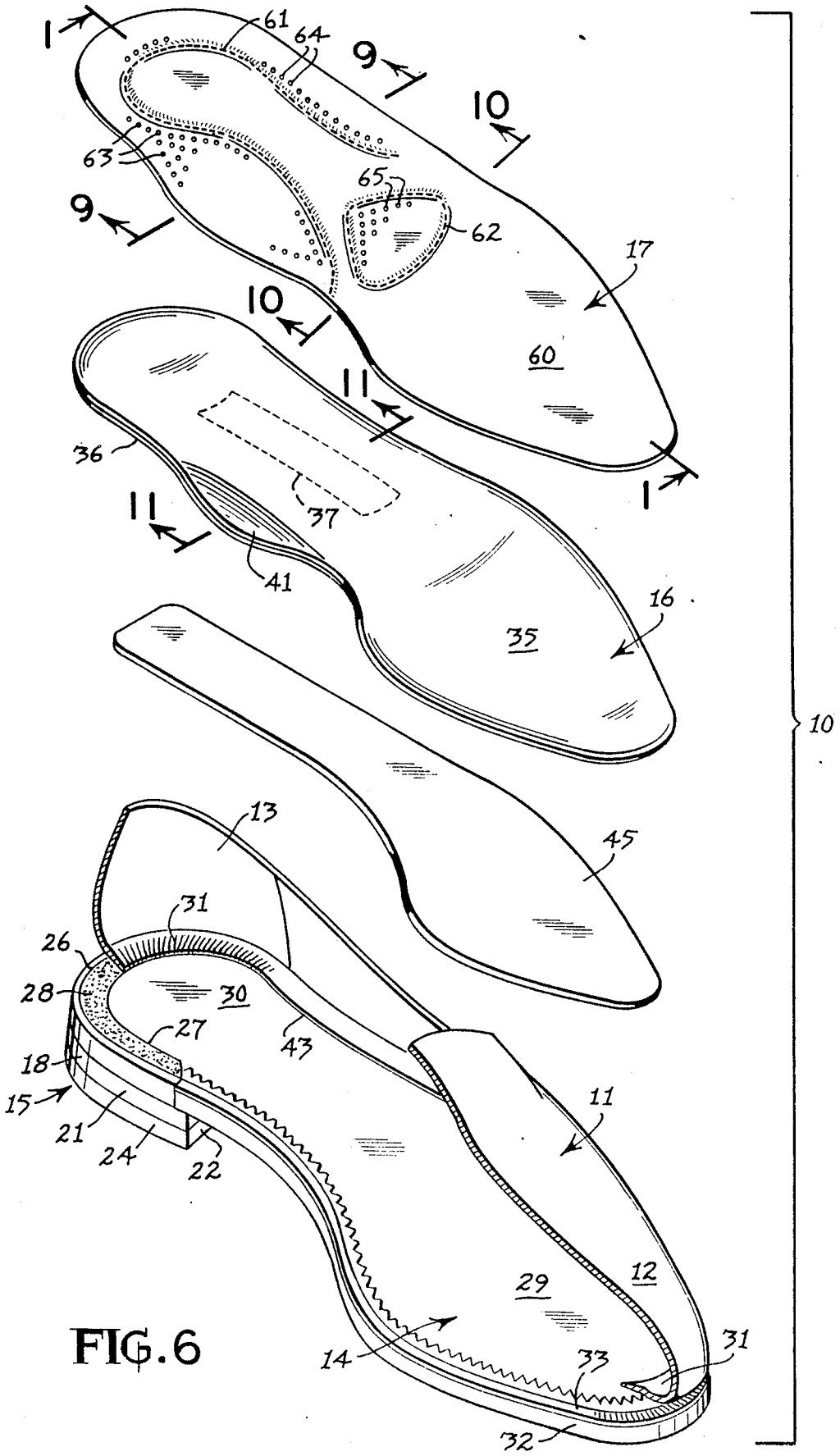
FIG. 6 is a top perspective exploded view of all of the parts of the shoe disclosed in FIG. 1, with the outsole member and heel assembled, and the upper shown in section.

In a preferred form of the invention, an elongated leather welt strip 33 is cemented to the top surface of the entire edge portion of the outsole member 14, excluding the backpart 30. The welt strip 33 begins at one edge abutting the front edge of one side of the rand 26, extending entirely along the top surface of the margin of the outsole member and terminating against the opposite front edge of the rand 26. As illustrated in FIG. 6, the welt strip 33 includes a design which simulates an actual welt construction. The outer edge of the strip 33 is highly dressed, styled, or polished.

As disclosed in FIGS. 1 and 6, the inturned bottom marginal portions 31 of the upper 11 are cemented to the upper surface 28 of the heel rand 26 and to the top of the welt strip 33.

Figure 7:
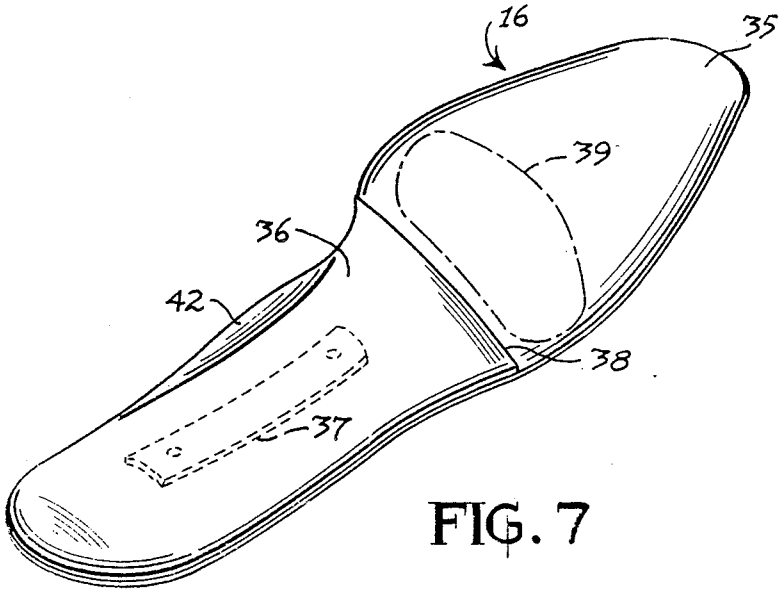
FIG. 7 is a bottom perspective view of the assembled insole member disclosed in FIG. 6.

As best disclosed in FIGS. 4, 6, and 7, the insole member 16 preferably includes three parts or layers, namely, an elongated top insole piece 35, a foreshortened backpart tuck piece 36, and an elongated metal shank 37.

The top insole piece 35 is substantially as long as the shoe 10 and has the general shape of the shoe. The top insole piece 35 is preferably made of a monolithic, flexible fiberboard material composed of cellulose fibers and a synthetic latex having a density, thickness and composition which will be very flexible, lightweight, breathable, and highly water absorptive. The synthetic fiberboard material is also highly elastic and is inert against bacteria and fungus cultures. The fiberboard material also functions as an excellent heat insulator. Thus, the top insole piece 35 retards the transfer of heat from a hot outside surface to the wearer's foot. A preferred form of composition fiberboard is "TEXON 437", which has proved to be highly successful in producing all of the above enumerated characteristics.

The tuck piece 36 is also made of a fiberboard composition, but is rigid to hold the shape of the insole in the backpart and the instep areas. The rigid fiberboard tuck piece 36 is coextensive with the backpart and intermediate portions of the top insole piece 35, but its front edge 38 terminates immediately behind the ball area 39 (FIG. 7) of the top insole piece 35.

As disclosed in FIG. 4, the elongated steel shank 37 is secured by rivets 40 to the top of the tuck 36. The length of the shank 37 is substantially less than that of the tuck piece 36 and the top insole piece 35. The tuck piece 36 and the assembled riveted shank 37 are secured to the bottom surface of the top insole piece 35 by cementing, so that the side and rear edges of both pieces 35 and 36 are flush or aligned, as best disclosed in FIG. 7.

Furthermore, as best disclosed in FIGS. 4, 6, and 7, the insole piece 35 and the tuck 36 are provided with laterally projecting curved instep portions 41 and 42 which curve upwardly against the inner portion of the upper on the inside of the shoe, when properly assembled within the shoe 10. The lower surface along the marginal edge portions of the insole member 16 are cemented to the upper surface of the inturned marginal portion 31 of the upper 12 continuously around the periphery of the upper 12 to secure the upper and the insole member 16 together.

Preferably, the insole member 16 and the upper 12 are assembled by tacking the laminated insole member 16 to the bottom of a last (not shown) and then cement-lasting the upper 12 about the last to the bottom marginal edge portions of the insole member 16. Then the combination heel member 15 and outsole member 14 are cemented to the bottom edge portion of the inturned upper margins 31.

After the upper 12 is cement-lasted to the insole member 16, and before the outsole member 14 is cemented to the upper, an elongated cavity 43 is formed within the periphery of the inturned margins 31 and the bottom surface of the insole member 16. This cavity 43 is filled with an elongated bottom filler 45. The bottom filler 45 is preferably of a monolithic flexible, urethane foam material extending substantially the entire length of the cavity 43 and occupying substantially all of the space within the cavity 43 from the heel to the forepart of the shoe. The bottom filler 45 is not only flexible, but substantially wrinkle-free when flexed, highly moisture absorbent and resilient, having an elasticity of at least 90%.

In the preferred form of the invention, the bottom filler 45 is made from "PORON", a urethane foam produced by the Rogers Corporation of East Woodstock, Conn. The bottom filler 45 made of urethane foam, and specifically "PORON 4300", has a high degree of energy absorption, and specifically more than 83% better shock absorption capability than latex foams commonly used for insole cushioning. Moreover, the "PORON" bottom filler 45 has up to 80% better shock absorption than conventional rubber. In addition, the bottom filler 45 is made of a material which is soft and pliable.

Figure 8:
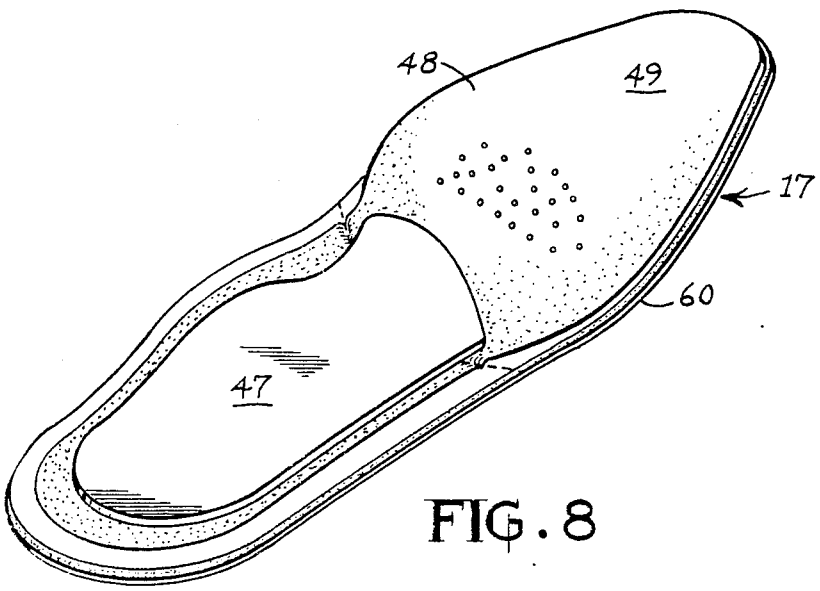
FIG. 8 is a bottom perspective view of the heel cushion member and socklining insert member assembled, as disclosed in FIG. 6.

Positioned above the hard and rigid backpart portion of the insole member 16 is a heel cushion member 47, which is elongated, extending from the back of the shoe or insole member 16 and terminating just short of the ball area 39 of the insole member 16, as best disclosed in FIGS. 1 and 8. As disclosed in FIG. 8, the heel cushion member 47 is lying on the bottom surface of the socklining insert member 17 in its final assembled position as it would appear when the insert member 17 is turned right-side up, and is further illustrated in FIG. 1. The heel cushion member 47 also has the same properties as the bottom filler 45 and is therefore preferably made of a flexible, resilient, water-absorbent, highly energy absorbent, soft, pliable material such as urethane foam, and specifically "PORON 4300".

As best disclosed in FIG. 1, it will be seen that the backpart portion of the insole member 16, and specifically the rigid backpart portion including the flexible backpart portion of the fiberboard top insole piece 35 laminated to the rigid tuck 36 including the rigid steel shank 37, is sandwiched between a pair of flexible, resilient, urethane foam members, specifically the backpart portion of the bottom filler 45 and the heel cushion member 47. Thus, both the top and bottom surfaces of the rigid hard backpart portion of the insole member 16, which protects the heel of the wearer, is cushioned by resilient cushion layers, specifically the bottom filler 45 and the heel cushion member 47. Moreover, the tuck piece 36 and the heel cushion member 47 are substantially of the same length, size and shape, and substantially coextensive with each other on opposite sides of the insole piece 35 This backpart area of protection is highly important since during ordinary walking, the wearer's heel always strikes the ground surface before any other portion of his foot and therefore is exposed to the maximum shock or force received by the lead foot striking the ground surface.

The socklining insert member 17 which is inserted within the upper 12 and upon the top of the heel cushion member 47 and the forepart portion of the insole member 16, and specifically the forepart portion of the top flexible insole piece 35 is preferably made of a lower or bottom synthetic foam insert piece 48 extending substantially the full length of the insole member 16. The insert piece 48 is preferably made of a monolithic, flexible, plastic material which is porous and has a bottom face 49 and a top face 50. The material from which the insert piece 48 is made is preferably an open-celled foam polyethylene material. This material is not only lightweight, but is also breathable, flexible and pliable. Preferably, the thickness of the insert piece 48 is substantially greater than the thickness of the "PORON" heel cushion member 47.

Contrary to the high resilience characteristics of many of the other elements in the shoe 10, and specifically the high resilience of the heel cushion member 47, the bottom filler 45, the insole piece 35, and the outsole member 14, the thick foam insert piece 48 has low resilience so that over a period of wear, it will conform to the shape of the wearer's foot to provide more uniform support for all parts of the bottom of the wearers's foot. Although, overall, low resilience is not a desirable characteristic for this particular shoe 10, nevertheless, the combination of the low resilient foam insert piece 48 and the high resilient heel cushion member 47 and the other high resilient elements provides "the best of both worlds" because adequate elasticity, "springyness", or rebound capacity for the shoe elements is provided by most of the elements in the shoe, while the cushion insert piece 48 becomes molded to shape of the wearer's foot to provide uniform pressure at each incremental area of the bottom surface of the wearer's foot.

Figure 9:
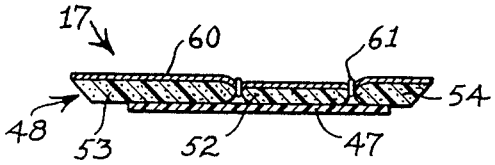
FIG. 9 is an enlarged section taken along the line 9—9 of FIG. 6.

In a preferred form of the invention, the top face or surface 50 of the insert piece 48 includes an elongated continuous groove 51 generally separating the central backpart area 52 of the insert piece from the oppositely projecting lateral backpart portions 53 and 54. It will be noted that the central backpart area 52 generally conforms to the shape of the heel and the instep, while the lateral portions 53 and 54 are separated to facilitate bending of the lateral portions 53 and 54 upward about the groove lines 51 in order to generally form a cup-shaped heel receptacle in the top surface 50 of the insert piece 48, as best disclosed in FIG. 2. It will also be noted, particularly in FIG. 9, the lateral portions 53 and 54 are thicker than the central backpart portion 52 so that the lateral portions 53 and 54 are elevated above the top surface of the central backpart portion 52.

Figure 10:
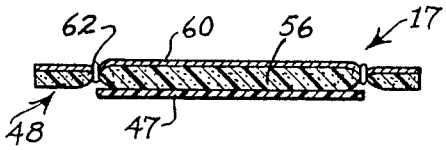
FIG. 10 is an enlarged section taken along the line 10—10 of FIG. 6.
Figure 2:
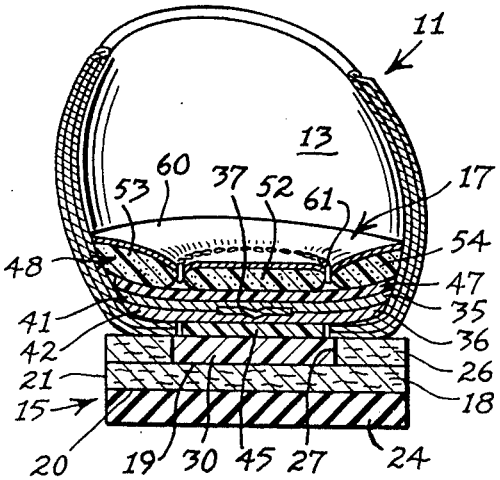
FIG. 2 is a transverse vertical section taken along the line 2—2 of FIG. 1.
Figure 3:
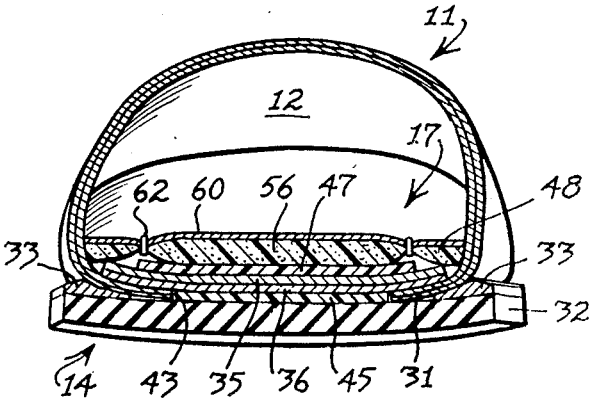
FIG. 3 is a transverse vertical section taken along the line 3—3 of FIG. 1.
Figure 11:
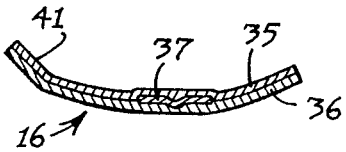
FIG. 11 is an enlarged section taken along the line 11—11 of FIG. 6.
Figure 5:
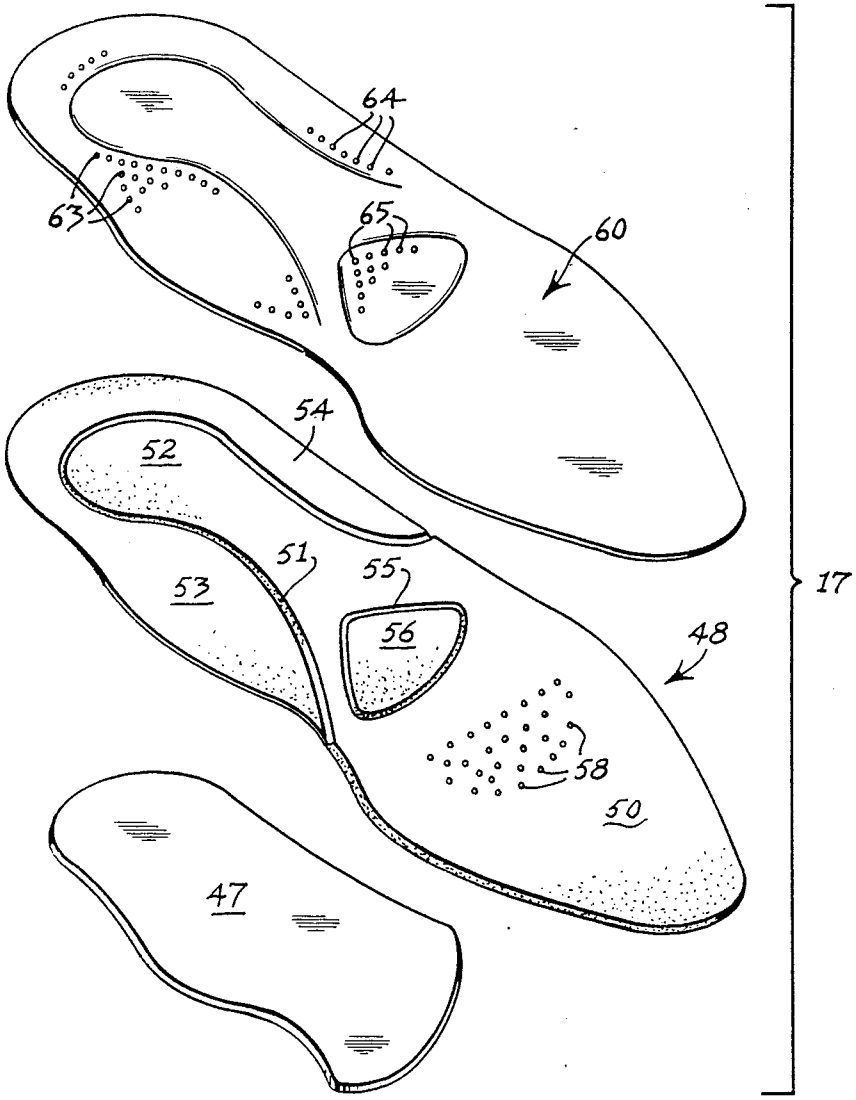
FIG. 5 is a top perspective exploded view of the socklining insert member and heel cushion member.

Furthermore, as best disclosed in FIGS. 5 and 10, the circumferential groove 55 is formed in the top surface 50 of the insert piece 48 in the area immediately behind the ball area to define a metatarsal pad 56. As best disclosed in FIG. 10, the metatarsal pad 56 is thicker than the surrounding area of the insert piece 48 so that the top surface of the metatarsal pad 56 projects above the surrounding top surface 50 in order to more adequately support the natural depressed area in the foot immediately behind the ball of the foot.

The forepart area of the top surface 50 may be perforated with apertures 58, if desired, to increase the porosity of the already porous material of the insert piece 48.

In order to improve not only the appearance, but also the comfort, of the shoe 10, the top surface 50 of the insert piece 48 is covered by a thin, flexible, preferably leather, sockliner 60. The extent of the sockliner 60 is substantially the same as that of the underlying insert piece 48, that is it is approximately the same size and has the same shape and contour to adequately cover the top face. Moreover, the sockliner 60 is stitched to the insert piece 48 by stitching 61 conforming to the groove 51 and by stitching 62 conforming to the groove 55, so that the same divisions between the central backpart portion 52 and the lateral portions 53 and 54 will appear in the sock liner 60. Moreover, the metatarsal pad 56 will also be emphasized by the stitching 62 in the sockliner 60.

The sockliner 60 may incorporate lateral perforations 63 and 64 extending entirely through the thickness of the sockliner as well as metatarsal perforations 65, if desired, to improve the circulation of air as well as water absorption. Moisture is drawn away from the foot through the sockliner 60 and into the highly water-absorbent, polyethylene foam material in the insert piece 48.

In a preferred form of the invention, the socklining insert member 17, including the insert piece 48 to which the sockliner 60 is stitched, is inserted within the upper 12 to extend the full length of the inside of the shoe. The insert member 17 is preferably cemented to the heel cushion member 47 and the forepart portion of the insole piece 35. The insole piece 35 is likewise cemented to the tuck to sandwich the shank 37 between the tuck 36 and the top insole piece 35. The entire bottom surface of the insole member 16 is cemented around its perimeter to the top surface of the inturned upper margins 31 and also to the top surface of the bottom filler 45. The bottom filler 45 is in turn cemented to the top outsole member 14 within the cavity 43, while the outsole member 14 is cemented to the bottom surface of the inturned margins 31 of the upper 11 and within the heel recess 27.

In the assembly of the shoe, the heel cushion member 47 may be inserted upon the backpart portion of the insole member 16 and cemented in place, and subsequently, the laminated insert member 17 including the insert piece 48 and the sock liner 60 may be separably inserted on top of the heel cushion member 47 and the insole member 17. Alternatively, the heel cushion member 47 may first be cemented to the bottom surface of the backpart portion of the insert piece 48, and the laminated heel cushion member 47 and the insert member 17 may be inserted as a unit, such as that disclosed in FIGS. 5, 6, and 8 into the upper 12 and upon the top of insole member 16.

A prototype of the above shoe 10 has been produced by the assignee, Genesco, Inc., of the applicant's, and has been referred to as the J & M Comfort Shoe, Stock No. 24-6405. The term "J & M" refers to the assignee's division Johnston & Murphy, which produces the highly styled, top-of-the-line shoes for the assignee. The shoe 10 has been tested with other styled shoes, both the competitors' and the assignee's, with the following results:

TEST RESULTS

TEST A:

Items Tested:

One-half (½) pair J & M Comfort St. No. 24-6405

One-half (½) pair DresSports by Rockport

One-half (½) pair Hamptons by Converse

Purpose: Comparison of comfort characteristics

1. Flexibility — complete shoe
2. Resilience — complete shoe, without upper
2. Breathability — socklining insert member
4. Water absorption — socklining insert member Testing 1. Flexibility Procedure: Each shoe was clamped in a fixed position and the force required to flex shoe 0.5, 1.0, 1.5 inches was measured with a Chatillon Gauge. The initial force to flex and the force required after 50 hand flexes were recorded. Lower number indicates better flexibility.

| | Force Required to Flex, Lbs. | | |
|---|---|---|---|
| Original | J & M Comfort | Rockport DresSports | Converse Hamptons |
| 0.5" | 3.25 | 4.00 | 5.00 |
| 1.0" | 4.00 | 5.25 | 7.00 |
| 1.5" | 4.50 | 6.00 | 7.75 |
| After 50 Flexes | | | |
| 0.5" | 2.25 | 4.00 | 4.00 |
| 1.0" | 3.00 | 4.75 | 5.75 |
| 1.5" | 3.00 | 5.50 | 7.50 |
| 2. Resilience (a) | | | |
| ASTM D 3564 | | | |
| Heel | 36.9% | 28.2% | 31.1% |
| Ball | 42.6% | 41.0% | 41.7% |
| 3. Breathability (b) | | | |
| Water Vapor Permeability mg/cm/hr Socklining Insert Member: | 1.754 | 1.586 | .015 |
| 4. Water Absorption | | | |
| TMI Method Socklining Insert Member: | 79.7% | 137.7% | 92.2% |

(a) Higher number indicates more resilience.
(b) High number indicates more breathability.

Comments

The J & M Comfort shoe had considerably more flexibility than Rockport and Converse.

J & M Comfort shoe proved to possess more resilience in the ball and heel areas than Rockport or Converse.

J & M and Rockport linings had excellent breathability. Both were much better than Converse.

The competitor linings had better absorption characteristics. However, J & M lining had very good water absorption.

TEST B:

Items Tested:

One-half (½) pair J & M Comfort 24-6405 — EVA Outsole

One-half (½) pair J & M Welt 24-6111 — Leather Outsole

Purpose: Comparison of comfort and durability

1. Flexibility — complete shoe
2. Resilience — complete shoe, without upper
3. Abrasion resistance — outsole
4. Sole adhesion (24-6405 only)

Testing:

1. Flexibility

Procedure: Each shoe was clamped in a fixed position and the force required to flex the shoe 0.5, 1.0, and 1.5 inches was measured with a Chatillon Gauge. The initial force to flex and the force required after 50 hand flexes were recorded. Lower numbers indicate more flexibility.

| | Force Required to Flex, Lbs. | | | |
|---|---|---|---|---|
| | J & M Comfort 24-6405 | | J & M Welt 24-6111 | |
| | Original | After 50 Flexes | Original | After 50 Flexes |
| 0.5" | 3.25 | 2.25 | 6.75 | 2.50 |
| 1.0" | 4.00 | 3.00 | 7.75 | 4.25 |
| 1.5" | 4.50 | 3.00 | 9.25 | 4.50 |

2. Resilience (a):

| | J & M Comfort 24-6405 | J & M Welt 24-6111 |
|---|---|---|
| Heel | 36.9% | 17.6% |
| Ball | 42.6% | 21.2% |

(a) Higher number indicates more resilience.

3. Abrasion Resistance
Taber Method

| H-18 wheels, 1 kg. wt. 2000 cycle end point | EVA | LEATHER |
|---|---|---|
| Weight loss in 1000 cycles | 111.4 mgs. | 371.4 mgs. |
| Weight loss in 1000 cycles | 0.61% | 0.91% |
| Mils loss in 2000 cycles | 4.77 mils | 7.50 mils |
| Average mils loss per 100 cycles | 0.24 mils | 0.38 mils |

4. Sole Adhesion

| | Forepart (lbs./max.) | Ball (lbs./max.) | Shank (lbs./max.) | Comments |
|---|---|---|---|---|
| J & M Comfort 24-6405 Right | 70.5 | 52.0 | 64.5 | Upper and soling failure |

Comments

J & M Comfort shoe had better flexibility.

J & M Comfort retained better resilience.

EVA outsole had better abrasion resistance than leather outsole on J & M Welt.

Very good sole adhesion on J & M Comfort shoe with high lbs. required for separation and heavy material failure.

The above tests show clearly the superior qualities and characteristics in the areas of flexibility, resilience, breathability, abrasion resistance, and sole adhesion of the shoe 10 made in accordance with this invention, when compared with other styled shoes, some of which are competitors' and some of which have been manufactured for improvement in comfort.

The Rockport "DresSports⇄ shoe includes an ethylene vinyl acetate (EVA) sole and heel, a cloth fabric covering a polyethylene insert piece with an inserted PORON heel pad. The single piece insole extends the full length of the shoe and is made of a blown or foam type synthetic material. The DresSport shoe also has a leather upper.

Converse's "Hamptons" dress shoe has a felt-covered foam layer insert. The Hamptons' insole includes a relatively hard backpart portion. A plastic shank fits on top of the insole backpart. The unitary outsole and heel of the Hamptons shoe is made of a synthetic composition material. The composition heel includes a rubber toplift, and a softer heel pad is inserted into a hole in the heel portion of the outsole.

The common assignee's J & M 24-6111 leather welt shoe is fabricated of a conventional welt construction having a leather outsole and a leather upper. The shoe includes a steel shank and a fiberboard tuck and includes either a leather or "TEXON" insole. The bottom filler is cork. There is no insert in the J & M 24-6111 shoe. The shoe includes a leather heel pad on top of the heel, with a small piece of styrofoam on the heel pad.

It will be apparent from the above description and the test results, that the highly styled comfort shoe 10 includes all of the above-described comfort characteristics and yet retains all of the highly styled esthetic appearance features of the assignee's Johnston & Murphy stylized dress shoe.

What is claimed is:

1. In a shoe construction:

(a) a heel member having a top surface, a bottom surface, a front edge portion, and styled side and rear surfaces, (b) an elongated flexible, resilient outsole member having a top face, a bottom surface, forepart and backpart portions and outside edge portions which are co-extensive with said side surfaces of said heel member, (c) said backpart portion of said outsole member being secured to said top surface of said heel member, (d) a styled upper having an inturned bottom marginal portion secured flush against said top surface of said outsole member adjacent said outside edge portions of said outsole member, said bottom marginal portion defining an elongated cavity above said outsole member, (e) an elongated filler member of flexible foam material seated within and occupying substantially the entire space within said cavity, said filler member being highly resilient and water absorptive, (f) an elongated insole member having forepart, backpart and intermediate portions top and bottom surfaces, and marginal edge portions secured on top of said inturned bottom marginal portion of said upper, (g) said backpart portion of said insole member being substantially rigid and said forepart portion of said insole member being flexible, (h) a resilient heel cushion member secured on top of said backpart portion of said insole member, (i) an elongated resilient socklining member comprising an elongated flexable, synthetic foam material substantially coextensive with said insole member and having a forepart portion, a backport portion, and an intermediate ball area, said backpart portion being secured to the top of said heel cushion member, (j) said backpart portion of said socklining member including elongated grooves separation said backpart portion into a central portion and a pair of lateral portions, the thickness of said lateral portions being slightly greater than the thickness of said central portion, said backpart portion having the general shape of the backpart portion of the wearer's foot.

2. The invention according to claim 1 in which said socklining member comprises a metatarsal pad area immediately behind said ball area, the portion of said socklining member in said metatarsal pad area being slightly thicker than the portion of said socklining member in said ball area.

3. The invention according to claim 2 in which the front portion of said heel cushion member terminates behind the ball area of said socklining member and covers said metatarsal pad area.

4. The invention according to claim 1 in which said socklining member further comprisese a leather lining cover substantially secured to the top surface of said socklining member and substantially coextensive therewith.

5. The invention according to claim 4 in which said socklining member is made of an open-cell polyethylene foam material.

6. The invention according to claim 4 in which said socklining member is made of a foam material of lesser resilience than the material of said heel cushion member.

7. The invention according to claim 4 in which said socklining member is received within said upper, and said central and lateral portions of said backpart portion of said socklining member define a cupped heel area.

8. The invention according to claim 1 in which said outsole member is made of a material lighter in weight than leather and which is highly resilient and more durable than leather.

9. The invention according to claim 8 in which said outsole member is made of ethylene vinyl acetate.

10. The invention according to claim 1 in which said elongated filler member is made of "Poron."

11. The invention according to claim 1 in which said insole member comprises an elongated insole piece extending substantially the full length of said insole member and being made of a composite flexible material substantially less dense, more porous and more water absorptive than natural leather and having a top face and a bottom face, said insole member further comprising a tuck piece of substantialy rigid fiber board having a top surface, a bottom surface, and fixed to the bottom surface of said top insole piece, the front portion of said tuck piece terminating at the intermediate portion of said insole piece.

12. The invention according to claim 11 further comprising an elongated steel shank secured between said insole piece and said tuck piece.

13. The invention according to claim 12 in which said insole piece is made of "TEXON 437".

14. The invention according to claim 12 in which said insole piece has high heat insulative properties.

15. The invention according to claim 11 in which said elongated heel cushion is substantially the same length as said tuck piece and is substantially coextensive with said tuck piece.

16. The invention according to claim 15 in which said heel cushion member is made of the same material as said filler member.

17. The invention according to claim 25 in which said top surface of said heel member comprises a recess therein enclosed by said side and rear surfaces of said heel member and opening forward through said front edge portion, said backpart portion of said outsole member terminating in a tongue portion of lesser width than said heel member and said outsole member, said tongue portion being received within said recess.

18. The invention according to claim 17 in which said tongue portion has a top surface substantially flush with said top surface of said heel member.

19. The invention according to claim 1 further comprising a styled elongated leather welt member secured to the top surface of the outside edge portions of said outsole member and to the inturned bottom marginal portions of said upper.

* * * * *